US007804674B2

(12) United States Patent
Keller et al.

(10) Patent No.: US 7,804,674 B2
(45) Date of Patent: Sep. 28, 2010

(54) POSITION RECOGNITION IN AN ELECTROMAGNETIC ACTUATOR WITHOUT SENSORS

(75) Inventors: Reiner Keller, Bodmann-Ludwigshafen (DE); Kai Heinrich, Waldburg (DE); Michael Pantke, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 579 days.

(21) Appl. No.: 11/911,588

(22) PCT Filed: Apr. 4, 2006

(86) PCT No.: PCT/EP2006/003040

§ 371 (c)(1),
(2), (4) Date: Oct. 15, 2007

(87) PCT Pub. No.: WO2006/111268

PCT Pub. Date: Oct. 26, 2006

(65) Prior Publication Data

US 2008/0191826 A1 Aug. 14, 2008

(30) Foreign Application Priority Data

Apr. 18, 2005 (DE) ..... 10 2005 018 012

(51) Int. Cl.
*H01H 47/00* (2006.01)

(52) U.S. Cl. ..... 361/152

(58) Field of Classification Search ..... 361/152
See application file for complete search history.

(56) References Cited

U.S. PATENT DOCUMENTS

| | | | | |
|---|---|---|---|---|
| 4,887,214 | A * | 12/1989 | Takats et al. | 701/3 |
| 5,889,645 | A * | 3/1999 | Kadah et al. | 361/191 |
| 5,917,692 | A | 6/1999 | Schmitz et al. | |
| 5,982,605 | A * | 11/1999 | Massey et al. | 361/210 |
| 6,762,922 | B2 | 7/2004 | Mednikov et al. | |
| 7,206,264 | B1 * | 4/2007 | Hermanns | 369/44.29 |
| 2003/0098686 | A1 | 5/2003 | Mednikov et al. | |

FOREIGN PATENT DOCUMENTS

| | | | |
|---|---|---|---|
| DE | 33 43 885 | A1 | 10/1984 |
| DE | 195 05 219 | A1 | 8/1996 |
| DE | 195 44 207 | A1 | 6/1997 |
| DE | 199 10 497 | A1 | 9/2000 |
| DE | 100 20 896 | A1 | 10/2001 |
| DE | 100 33 923 | A1 | 1/2002 |
| DE | 103 10 448 | A1 | 9/2003 |
| JP | 07-224624 | | 8/1995 |

* cited by examiner

*Primary Examiner*—Stephen W. Jackson
(74) *Attorney, Agent, or Firm*—Davis & Bujold, P.L.L.C.

(57) ABSTRACT

An electromagnetic actuator and a method for controlling the actuator comprising at least one armature (3) and two coils (1, 2). The voltage gradient at the two coils (1, 2) is measured during a sudden increase in voltage. From this measured data, a subtractor (16) computes a third voltage gradient (25) from which a logic unit (17) determines the position of the armature (3) without the use of an additional sensor.

15 Claims, 4 Drawing Sheets

POSITION RECOGNITION IN AN ELECTROMAGNETIC ACTUATOR WITHOUT SENSORS

This application is a national stage completion of PCT/EP2006/003040 filed Apr. 4, 2006, which claims priority from German Application Serial No. 10 2005 018 012.4 filed Apr. 18, 2005.

FIELD OF THE INVENTION

The invention relates to an electromagnetic actuator comprising at least two coils, an armature and a control or power electronics element and to a method for controlling such an actuator.

BACKGROUND OF THE INVENTION

DE 103 10 448 A1 discloses an electromagnetic actuator comprising two coils and an armature. By applying a current to the coils, the armature is displaced in the axial direction.

DE 199 10 497 A1 describes a method, according to which the position of an armature in an actuator is detected with a coil by determining the differential induction of the coil. For this purpose, the current decrease time during a drop in current is determined as a time difference between two threshold values. The current drop time is highly dependent on the resistance of the coil, which is temperature-dependent.

Furthermore, DE 100 33 923 A1 discloses a method, according to which the position of an armature is determined as a function of the counter-induction created by the movement of an armature in a coil. The counter-induction is dependent on the velocity of the armature. If such an actuator is used in a fluid-filled space, the velocity of the armature is highly dependent on the viscosity of the fluid. Also the viscosity of the fluid is dependent on the temperature.

It is therefore the object of the invention to enable determination of the position of an actuating member in an electromagnetic actuator without additional sensors, wherein the position determination in particular is supposed to be independent of the temperature.

SUMMARY OF INVENTION

According to the invention, an actuator is proposed, which comprises at least two coils, an armature and a control or power electronics element. The power electronics element is connected to a logic unit and is controlled by the same. The power electronics element at least comprises switches, which are switched on or off, enabling or interrupting a power supply. Current can be applied to the two coils via the switches. According to the invention, the armature can be displaced and/or the position of the armature can be measured by controlling the current in the coils. The armature is slidably mounted between the two coils and can be displaced back and forth between two end positions, such that the armature may also assume intermediate positions. A measurement amplifier is connected to the two coils, respectively, and measures the voltage gradient at the coils over time. The measurement signals of the measuring amplifiers are forwarded to a differentiator. In the subtractor, a third voltage gradient is computed from the measurement signals, the gradient comprising a maximum value that is dependent on the position of the armature. This is based on the fact that the inductance of a coil increases when an armature is inserted. Since the resistance of a coil depends on the inductance thereof, the armature position influences the voltage gradient. The logic unit detects the maximum value of the third voltage gradient and computes the armature position as a function thereof.

In one embodiment, the power electronics element comprises 3 or 4 switches. The logic unit comprises, for example, a μ controller or μ processor.

The equivalent circuit of one of the at least two coils can be represented for alternating current models by a familiar oscillating L-C-R circuit. Such an oscillating circuit is made of first and second alternating current resistors connected in parallel. The first alternating current resistor comprises a model coil and an ohmic resistor connected in series, the second alternating current resistor comprises a capacitor and a further ohmic resistor connected in series. Both alternating current resistors are dependent on the frequency of the excitation. According to the invention, a voltage jump is applied to the coils by applying sudden current. This moment, the switch-on moment, can be achieved by applying alternating current with infinitely high frequency $f \rightarrow \infty$ to the coils. The alternating current resistance of the model coils depends on the coils' inductance. Since the inductance of a coil increases when an armature is inserted therein, the alternating current resistances of the model coils change as a function of the armature position.

According to the invention, the voltage gradients at the two coils are measured by the measurement amplifiers. If a sudden increase in voltage is applied to the coils and the armature is not located in the center between the two coils, two different voltage gradients are produced in the two coils. These are subtracted from one another in the subtractor, resulting in a gradient with a maximum value corresponding to the armature position. This third voltage gradient is forwarded to a logic unit, which recognizes the maximum value. In accordance with the maximum value, the logic unit can determine the armature position, for example by comparison with a characteristic diagram.

By forming the difference between the two voltage gradients, the influence of interference acting on the two coils is also excluded. In known actuators comprising only one coil, for example, electromagnetic interferences may influence the voltage gradient in the coil and thus the position determination. In one advantageous embodiment, two identical coils are used, creating an electromagnetically symmetrical actuator. In this way, interference on the two coils always has the same effect. Since the two voltage gradients of the two coils are subtracted from each other, this interference has no influence on the measurement result. Furthermore, temperature effects are excluded by the inventive solution. By applying a voltage jump to the coils, the ohmic portion of the alternating current resistance is negligibly small compared to the frequency-dependent portion of the alternating current resistance. As a result, at the time the voltage jump is applied, the voltage gradient depends on the frequency-dependent portion of the alternating current resistance, which is dependent on the position of the armature, but not on the ambient temperature.

BRIEF DESCRIPTION OF THE DRAWINGS

The invention will now be described, by way of example, with reference to the accompanying drawings in which.

DETAILED DESCRIPTION OF THE INVENTION

Figure 1:
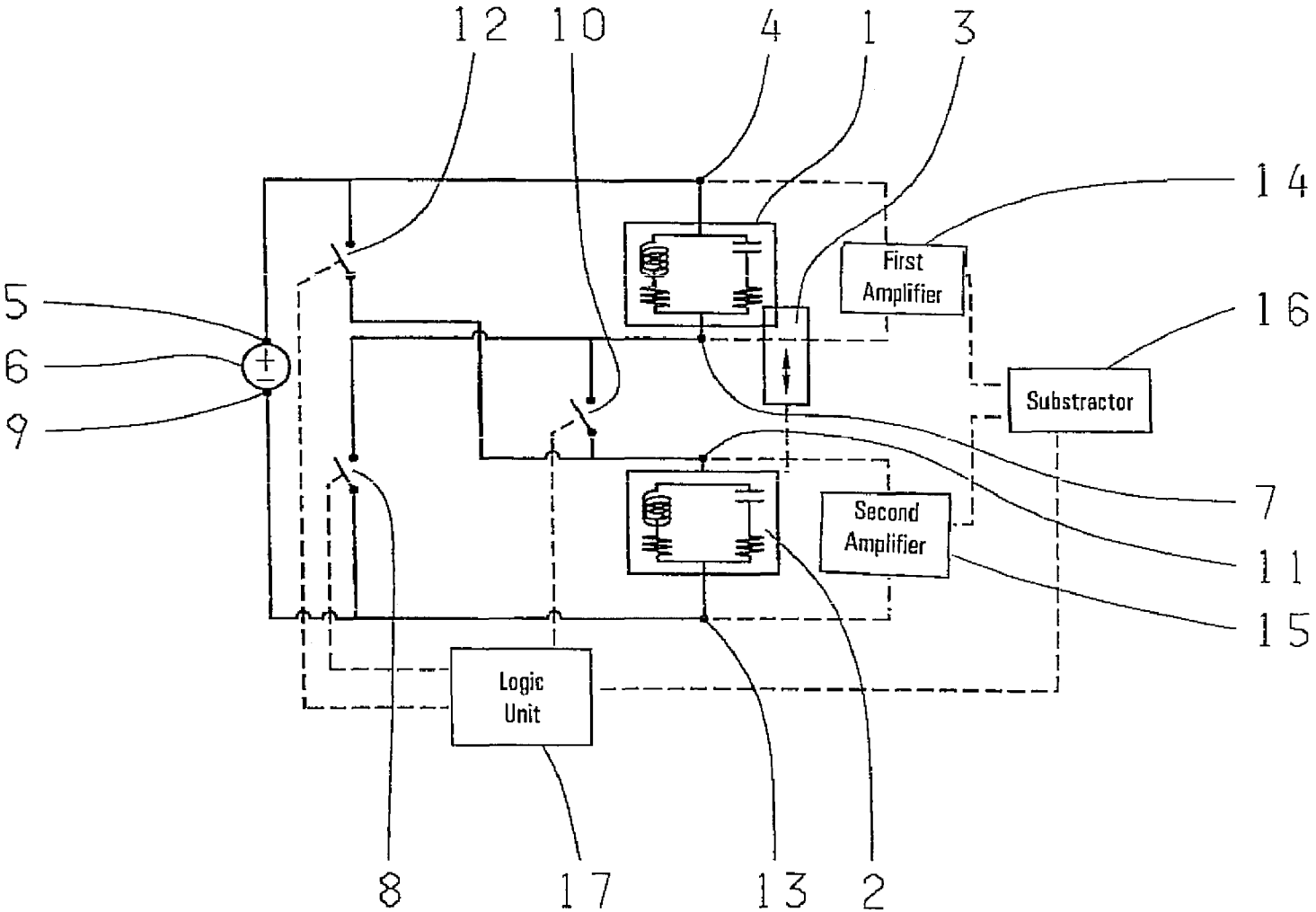
FIG. 1 is a schematic diagram of an actuator.

FIG. 1 shows an electromagnetic actuator comprising two coils 1, 2 and an armature 3. The armature 3 is slidably mounted between the two coils 1, 2. The input of the first coil 1 is connected to a first pole 5 of a power source 6. The output 7 of the first coil 1 can either be connected to the second pole 9 of the power source 6, via a first switch 8, or to the input 11 of the second coil 2 via a third switch 10. The input 11 of the second coil 2 can either be connected to the first pole 5 of the power source 6, via a second switch 12, or to the output 7 of the first coil 1, via a third switch 10. The three switches 8, 10, 12 form the power electronics element of the actuator. The output 13 of the second coil 2 can in turn be connected to the second pole 9 of the power source 6. A measurement amplifier 14, 15 is connected to the input and output 4, 7 of the first coil 1 and the input and output 11, 13 of the second coil 2, respectively. The measuring amplifiers 14, 15 are connected to the subtractor 16, which is connected to the logic unit 17 to which it forwards the data. The logic unit 17 controls the three switches 8, 10, 12. The three switches 8, 10, 12 can be controlled such that either the armature 3 is displaced or that a voltage jump is applied to the two coils 1, 2. If the logic unit 17 controls the first and second switches 8, 12 such that they are opened and at the same time the third switch 10 is closed, a voltage jump is applied to the two coils 1, 2. At the moment of application, the position of the armature 3 is determined from the voltage gradient at the two coils 1, 2. The arrangement according to the invention thus enables detection of the position of an actuating member without using an additional sensor. In this way, cost and installation space can be saved.

Figure 2:
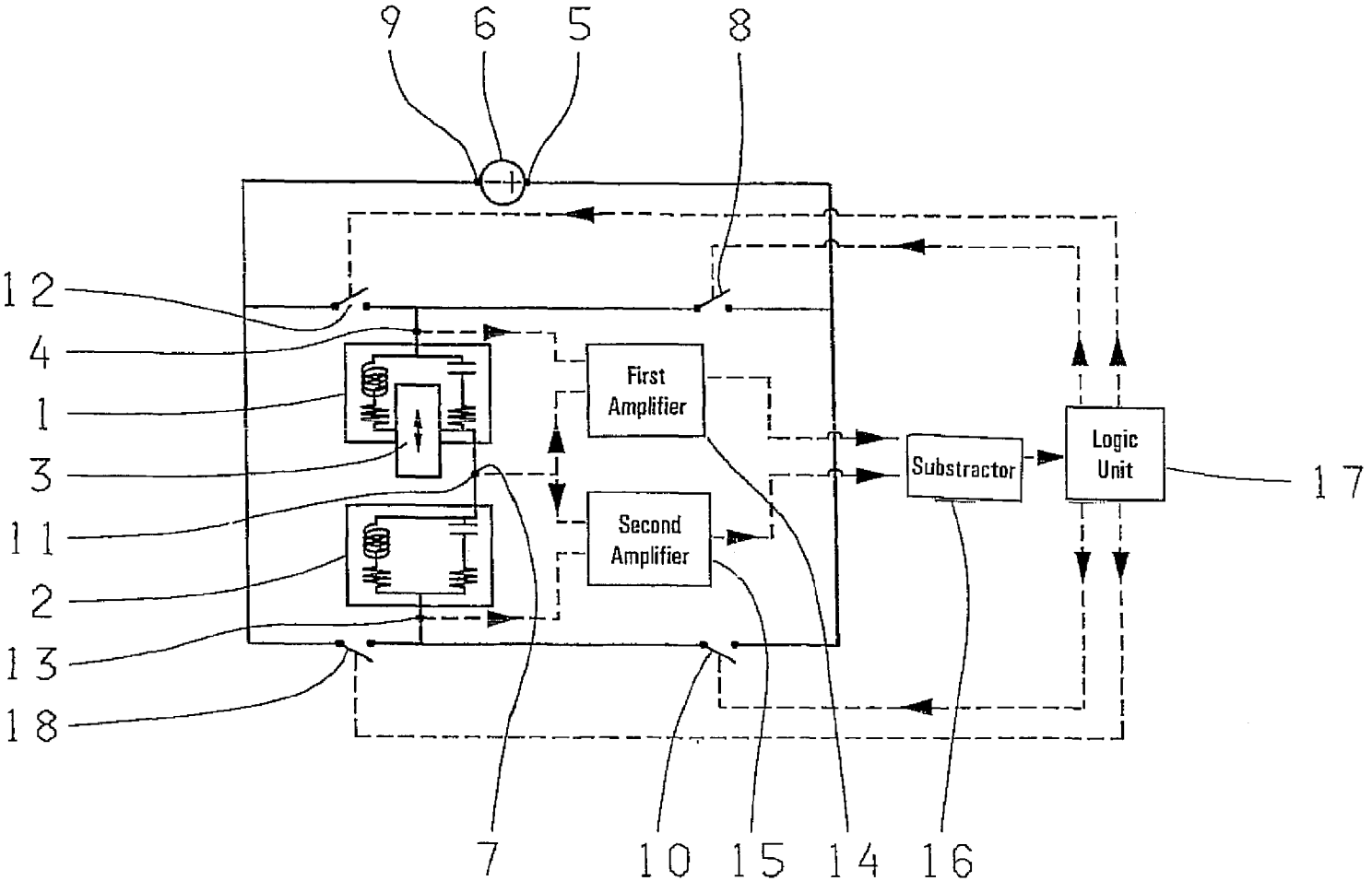
FIG. 2 is a schematic diagram of an actuator comprising a permanent magnet armature.

FIG. 2 shows a further embodiment of an electromagnetic actuator comprising two coils 1, 2 and an armature 3. This is a permanent magnet armature. In addition, the two coils 1, 2 are wound in opposite directions, which is to say that the winding direction of a first coil 1 is opposite from the winding direction of the second coil 2. The input 4 of the first coil 1 can either be connected to the first pole 5 of the power source 6, via the first switch 8, or to the second pole 9, via the second switch 12. The output 7 of the first coil 1 is connected to the input 11 of the second coil 2. The output 13 of the second coil 2 can either be connected to the first pole 5 of the power source 6 via a third switch 10, or to the second pole 9, via the fourth switch 18. A measurement amplifier 14, 15 is connected to the input and output 4, 7 of the first coil 1 and to the input and output 11, 13 of the second coil 2, respectively. The measurement amplifiers 14, 15 are furthermore connected to the subtractor 16. The subtractor 16 forwards data to the logic unit 17. The logic unit 17 controls the four switches 8, 10, 12, 18, which form the power electronics element of the actuator. By controlling the power electronics element, the armature 3 can be displaced and the position thereof can be measured at the same time. This arrangement according to the invention thus enables detection of a position of an actuating member without using an additional sensor. In addition, the position can also be measured during the switching processes. This saves cost and installation space in addition to time. In this configuration, the voltage jump is applied by two switch positions. Either the first and fourth switches 8, 18 or the second and third switches 12, 10 are closed. In the first case, the input 4 of the first coil 1 is connected to the first pole 5 of the power source 6 and the output 13 of the second coil 2 is connected to the second pole 9 of the power source 6. In the second case, the input 4 of the first coil 1 is connected to the second pole 9 and the output 13 of the second coil 2 is connected to the first pole 5 of the power source 6. Since the two coils 1, 2 are directly connected to one another, both cases produce a voltage jump. In an advantageous embodiment, a pulse width modulating signal is applied to the armature 3 for displacement. Since in the case of such a signal, the voltage is continuously switched on and off, a voltage jump is continuously applied to the coils 1, 2. As a result, the position of the armature 3 can be determined at any time that the voltage signal is switched.

Figure 3:
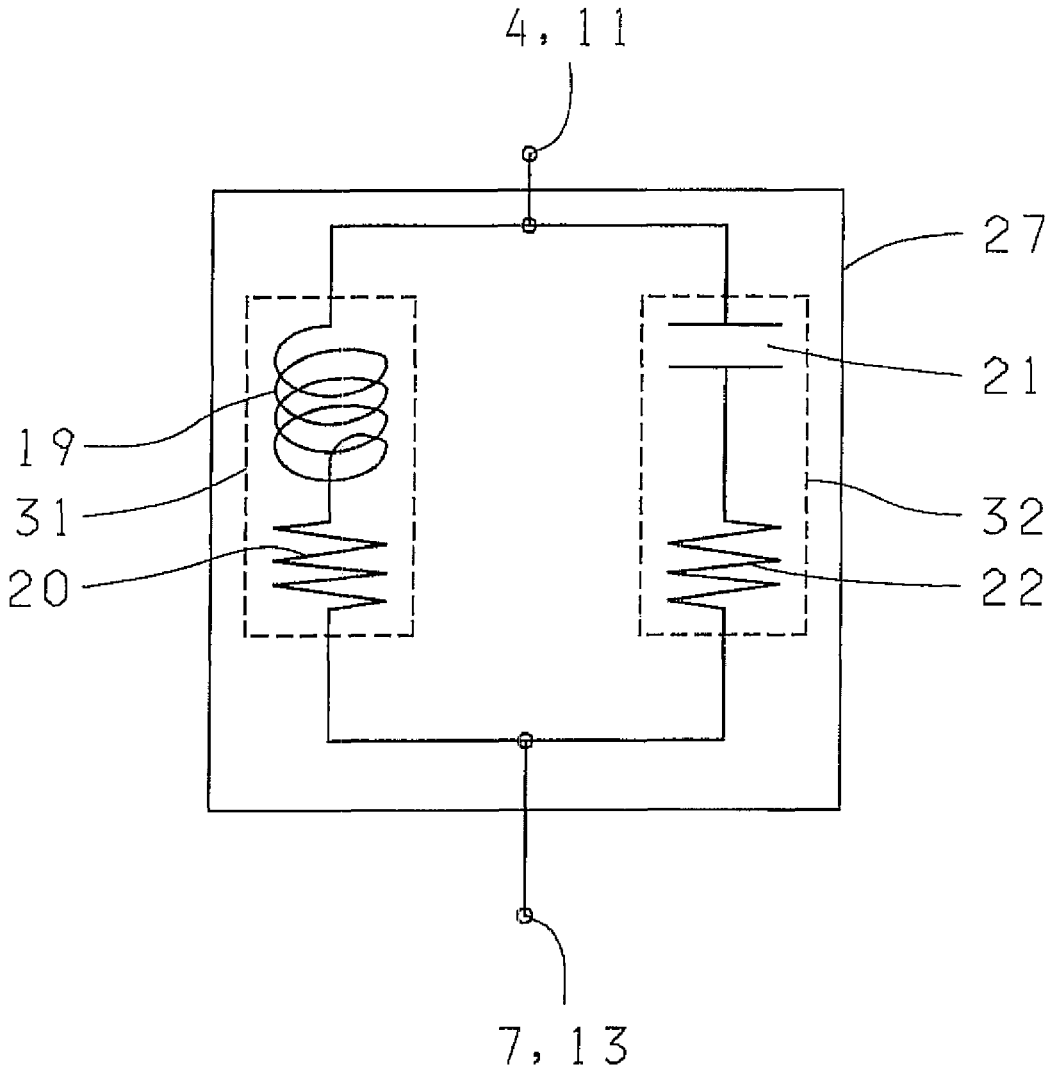
FIG. 3 is a schematic diagram of an LCR oscillating circuit.

FIG. 3 shows the design of a known LCR oscillating circuit 27, which the coils 1, 2 may comprise when an alternating current is applied. The input of the oscillating circuit corresponds to the inputs 4, 11 of the coils. The output of the oscillating circuit corresponds to the outputs 7, 13 of the coils. The oscillating circuit comprises two paths. The first path is produced by the model coil 19 and a first ohmic resistor 20 and forms a first alternating current resistor 31. The second path is produced by a capacitor 21 and a second ohmic resistor 22 and forms a second alternating current resistor 32.

Figure 4:
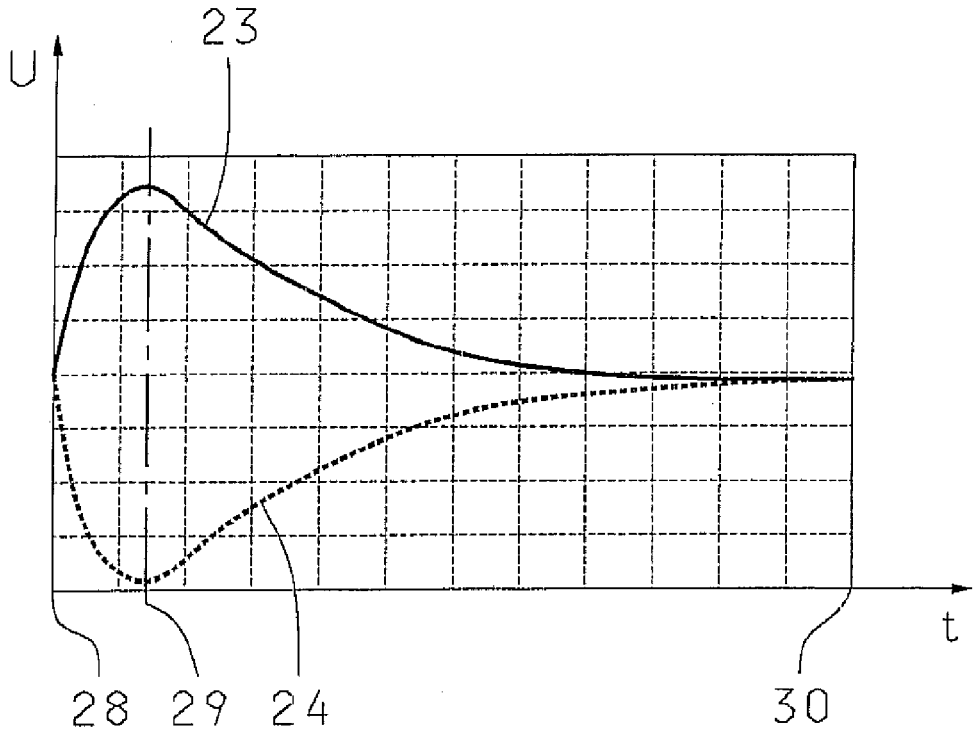
FIG. 4 are the measured voltage gradients at the two coils.

FIG. 4 shows a voltage gradient measured by the measuring amplifiers 14, 15 at the two coils 1, 2. A point in first time 28 describes the switch-on time at which a voltage jump is applied to the two coils 1, 2. By way of example, this is achieved by applying an alternating current with an infinitely high frequency $f \rightarrow \infty$. As a result, the gradient of the voltages at the coils 1, 2 depends on the respective alternating current resistors 31, 32. Up to a second point in time 29 (e.g., 5 ms), a first voltage gradient 23 to a maximum value and the second voltage gradient drops to a minimum value. The gradient up to the first time 28 is based on the influence of the parasitic capacitors 22. These occur as a function of the operating principle due to the interaction between the individual windings of the coils. The alternating current resistance of a capacitor trends toward zero at $f \rightarrow \infty$. During the charging of the capacitor, the resistance thereof increases. After the second point in time 29, a transient oscillation process begins and the current flows through the model coil 19 up to a third time 30 (e.g., 50 ms). The alternating current resistor 31 is dependent on the inductance of the model coil 19, which in turn depends on the position of the armature 3. The inductance increases with the distance that an armature 3 is inserted in a coil. At the third point in time 30, the transient oscillation process is complete and the voltage gradients 23, 24 are only determined by the two ohmic resistors 20 of the two coils 1, 2. At the end of the transient oscillation process, direct current states prevail again. The direct current resistances of the two coils 1, 2 are advantageously the same, resulting in no difference between the two voltage gradients 23, 24 any longer. FIG. 4 shows the first voltage gradient 23, for example the voltage gradient of the first coil 1 when the armature 3 is inserted therein. The second voltage gradient shows the voltage gradient in the second coil 2.

Figure 5:
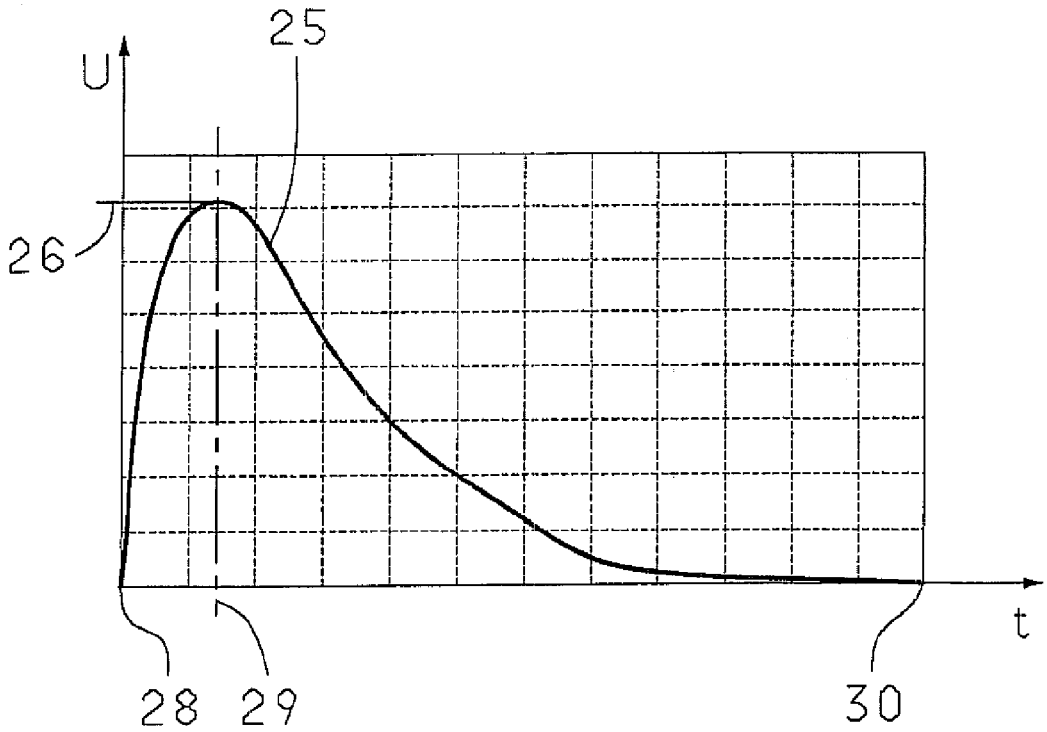
FIG. 5 is the computed voltage gradients from the two coils.

In the subtractor 16 then the two measured voltage gradients 23, 24 are subtracted from each other. This produces a third voltage gradient 25 in accordance with FIG. 5. The maximum value 26 of the third voltage gradient 25 is used in the logic unit 17 to determine the armature position, for example by comparing a characteristic diagram that is stored there.

| Reference numerals | |
|---|---|
| 1 | coil |
| 2 | coil |
| 3 | armature |
| 4 | input of the first coil |
| 5 | first pole of a power source |

-continued

| Reference numerals | |
|---|---|
| 6 | power source |
| 7 | output of the first coil |
| 8 | first switch |
| 9 | second pole of a power source |
| 10 | third switch |
| 11 | input of the second coil |
| 12 | second switch |
| 13 | output of the second coil |
| 14 | first measurement amplifier |
| 15 | second measurement amplifier |
| 16 | subtractor |
| 17 | logic unit |
| 18 | fourth switch |
| 19 | model coil |
| 20 | resistor |
| 21 | capacitor |
| 22 | resistor |
| 23 | first voltage gradient |
| 24 | second voltage gradient |
| 25 | third voltage gradient |
| 26 | maximum value |
| 27 | LCR oscillating circuit |
| 28 | first point in time |
| 29 | second point in time |
| 30 | third point in time |
| 31 | first alternating current resistor |
| 32 | second alternating current resistor |

The invention claimed is:

1. An electromagnetic actuator comprising at least one armature (3), a first coil (1), a second coil (2) and one of a control electronics element and a power electronics element, the armature (3) being slidably mounted between the first coil (1) and the second coil (2), the first coil (1) having an input (4) and an output (7), both of which are connected to a first measurement amplifier (14), the second coil (2) having an input (11) and an output (13), both of which are connected to a second measurement amplifier (15), the first measurement amplifier (14) and the second measurement amplifier (15) being connected to a subtractor (16), which is connected to a logic unit (17), and the logic unit (17) being connected to the one of the control electronics element and the power electronics element.

2. The actuator according to claim 1, wherein the one of the control electronics element and the power electronics element comprises at least three switches (8, 10, 12, 18).

3. The actuator according to claim 1, wherein the logic unit (17) comprises one of a microcontroller and a mircoprocessor.

4. The actuator according to claim 1, wherein the input (4) of the first coil (1) is connected to a first pole (5) of a power source (6);

the output (7) of the first coil (1) is connected to one of a second pole (9) of the power source (6), via a first switch (8), and the input (11) of the second coil (2), via a third switch (10);

the input (11) of the second coil (2) is connected to one of the first pole (5) of the power source (6), via the second switch (12), and the output (7) of the first coil (1), via the third switch (10); and the output (13) of the second coil (2) is connected to the second pole (9) of the power source (6).

5. The actuator according to claim 1, wherein the input (4) of the first coil (1) is connected to a first pole (5) of a power source (6), via a first switch (8), and a second pole (9) of the power source (6), via a second switch (12);

the output (7) of the first coil (1) is connected to the input (11) of the second coil (2); and the input (13) of the second coil (2) is connected to one of the first pole (5), via a third switch (10), and the second pole (9) of the power source (6), via a fourth switch (18).

6. The actuator according to claim 5, wherein a winding of the first coil (1) is opposite from a winding of the second coil (2, 1).

7. The actuator according to claim 5, wherein the armature (3), slidably mounted between the first coil (1) and the second coil (2), is a permanent magnet.

8. The actuator according to claim 1, wherein the first coil (1) is identical to the second coil (2).

9. A method for controlling an electromagnetic actuator comprising at least one armature (3), a first coil (1), a second coil (2) and one of a control electronics element and a power electronics element, the armature (3) being slidably mounted between the first coil (1) and the second coil (2), the first coil (1) having an input (4) and an output (7), both of which are connected to a first measurement amplifier (14), the second coil (2) having an input (11) and an output (13), both of which are connected to a second measurement amplifier (15), the first measurement amplifier (14) and the second measurement amplifier (15) being connected to a subtractor (16), which is connected to a logic unit (17), and the logic unit (17) being connected to the one of the control electronics element and the power electronics element, the method comprising the steps of:

applying a sudden increase in voltage to the first coil (1) and the second coil (2);

measuring, over time, a first voltage gradient (23) at the first coil (1) with a first measurement amplifier (14) and measuring a second voltage gradient (24) at the second coil (2) with a second measurement amplifier (15);

transferring the first voltage gradient (23) and the second voltage gradient (24) to the subtractor (16) for computation of a third voltage gradient (25); and transferring the third voltage gradient (25) to the logic unit (17) for evaluation.

10. The method according to claim 9, further comprising the steps of:

controlling one of the control electronics element and the power electronics element with the logic unit (17) to apply the sudden increase in voltage to the first coil (1) and the second coil (2);

calculating a difference between the first voltage gradient (23) and the second voltage gradient (24) and computing the third voltage gradient (25) with the subtractor (16) using the difference between the first voltage gradient (23) and the second voltage gradient (24); and determining a position of the armature (3) with the logic unit (16) with the position of the armature (3) being a function of a maximum value (26) of the third voltage gradient (25).

11. The method according to claim 10, further comprising the steps of:

opening a first switch (8) and a second switch (12) and closing a third switch (10) with one of the control electronics element and the power electronics element, which is controlled by the logic unit (17), to connect the first coil (1) and the second coil (2) in series; and connecting the input (4) of the first coil (1) to the first pole (5) of the power source (6) and the output (13) of the second coil (2) to the second pole (9) of the power source (6) to apply the sudden increase in voltage to the first coil (1) and the second coil (2).

12. The method according to claim 10, further comprising the step of closing a first switch (8) and a fourth switch (18) with the logic unit (16) to connect the input (4) of the first coil (1) with the first pole (5) of the power source (6) and connect the output (7) of the second coil (2) with the second pole (9) of the power source (6).

13. The method according to claim 10, further comprising the step of closing a second switch (12) and a third switch (10) with the logic unit (16) to connect the input (4) of the first coil (1) with the second pole (9) of the power source (6) and connect the output (13) of the second coil (2) with the first pole (5) of the power source (6).

14. The method according to claim 12, further comprising the step of applying a pulse width modulating signal to the armature (3) with the logic unit (16) via one of the control electronics element and the power electronics element.

15. An electromagnetic actuator of a motor vehicle transmission comprising at least one armature (3), a first coil (1), a second coil (2) and one of a control electronics element and a power electronics element, the armature (3) being slidably mounted between the first coil (1) and the second coil (2), the first coil (1) having an input (4) and an output (7) which are both connected to a first measurement amplifier (14), the second coil (2) has an input (11) and an output (13) which are both connected to a second measurement amplifier (15), the first measurement amplifier (14) and the second measurement amplifier (15) being connected to a subtractor (16), which is connected to a logic unit (17), and the logic unit (17) being connected to the one of the control electronics element and the power electronics element.

* * * * *